United States Patent [19]

Ellison

[11] Patent Number: 4,524,034

[45] Date of Patent: Jun. 18, 1985

[54] CARBURETOR

[76] Inventor: Benjamin L. Ellison, 350 Airport Way, Renton, Wash. 98055

[21] Appl. No.: 550,301

[22] Filed: Nov. 9, 1983

Related U.S. Application Data

[63] Continuation-in-part of Ser. No. 367,897, Apr. 13, 1982, abandoned, which is a continuation-in-part of Ser. No. 270,593, Jun. 4, 1981, abandoned.

[51] Int. Cl.[3] ..... F02M 9/06

[52] U.S. Cl. ..... 261/44 A; 261/44 B; 261/DIG. 68

[58] Field of Search ..... 261/44 A, 44 B, DIG. 68

[56] References Cited

U.S. PATENT DOCUMENTS

| | | | |
|---|---|---|---|
| 1,142,763 | 6/1915 | Perry | 261/41 B |
| 1,213,807 | 1/1917 | Miller et al. | 261/44 D |
| 1,457,112 | 5/1923 | Gormley et al. . | |
| 1,688,285 | 10/1928 | Purvis et al. | 261/44 A |
| 1,692,299 | 11/1928 | Harding | 261/44 B |
| 1,711,748 | 5/1929 | Schley | 261/44 A |
| 1,875,557 | 9/1932 | Brown | 261/44 B |
| 1,944,309 | 1/1931 | Vogel | 261/60 |
| 2,323,639 | 7/1943 | Anderson | 261/34 A |
| 2,763,538 | 9/1956 | Pilling et al. | 48/184 |
| 3,030,084 | 4/1962 | Phillips | 261/DIG. 68 |
| 3,246,886 | 4/1966 | Goodyear et al. | 261/39 |
| 3,709,469 | 1/1973 | Edmonston et al. | 261/44 |
| 3,752,454 | 8/1973 | Korponay | 261/44 B |
| 3,834,679 | 9/1974 | Baribeau et al. | 261/41 |
| 3,957,930 | 5/1976 | Birmingham | 261/44 |
| 4,123,479 | 10/1978 | Andreassen | 261/44 B |
| 4,205,024 | 5/1980 | Hirosawa | 261/34 |
| 4,257,379 | 3/1981 | Hickling | 261/44 B |

FOREIGN PATENT DOCUMENTS

| | | | |
|---|---|---|---|
| 700026 | 12/1930 | France | 261/44 |
| 234422 | 9/1944 | Switzerland | 261/44 |
| 198026 | 5/1923 | United Kingdom | 261/44 B |

OTHER PUBLICATIONS

"Technical Notes, 80 H.P. LeRhone", Department of Aircraft Production.

*Primary Examiner*—Tim Miles

*Attorney, Agent, or Firm*—Lee, Smith & Zickert

[57] ABSTRACT

An improved carburetor having a system for precisely metering fuel introduced into an internal combustion engine. The carburetor includes an air passageway and a throttle valve having a throttle opening movable across the air passageway to control the effective cross-sectional dimension of the air passageway. The fuel metering system includes an fuel metering tube extending across the air passageway in registration with the throttle valve. The metering tube is either connected to and movable with the throttle valve, or is stationary and extends through a complementary lateral aperture in the throttle valve such that the throttle valve is slidable upon the metering tube. A longitudinal fuel distribution outlet extends along one side of the fuel metering tube substantially across the width of the air passageway. In one embodiment, fuel pressure is maintained approximately equal to the total pressure of the air in the air passageway and fuel flow is regulated by varying the percentage of the airflow dynamic pressure that retards the discharge of fuel out of the distribution outlet. In another embodiment the fuel discharge outlet is oriented so as to sense the static pressure of the air in the air passageway while the fuel pressure is maintained at a variable percentage of the air flow dynamic pressure.

25 Claims, 22 Drawing Figures

32
154
28
10
30
14'
62
40'
18
152
98
92
96
94
144
142
156
146
140
148
150

CARBURETOR

RELATED APPLICATION

This application is a continuation-in-part of my copending U.S. patent application Ser. No. 367,897, filed Apr. 13, 1982, now abandoned, which in turn in a continuation-in-part of my copending U.S. patent application Ser. No. 270,593, filed June 4, 1981, now abandoned.

BACKGROUND OF THE INVENTION

This invention relates to fuel carburetion, and in particular to an improved carburetor having a fuel metering system for supplying a homogeneous mixture of fuel and air across the throttle opening of the carburetor while precisely controlling fuel and air flow rates.

For so long as internal combustion engines have been in existence, various carburetors have been developed to supply a required air-fuel mixture to the engine to promote proper and efficient combustion. Although myriads of carburetion schemes and devices have been developed, a continuing problem has been metering of the air-fuel mixture in a consistently homogeneous blend such that the air-fuel mixture received by each cylinder of the internal combustion engine is essentially the same as that supplied to each other cylinder.

In addition, not only is it important to control the homogeneity of the fuel-air mixture, it is also important to control the actual quantity of the fuel injected into the air stream in relation to the density of the air passing through the carburetor. Thus, when the air density decreases, it is important to also reduce the fuel flow rate so that the air-fuel blend supplied to the internal combustion engine is not fuel rich. This is particularly important in aircraft, where at high altitudes, the air density is considerably reduced. A commensurate reduction in the flow rate of the fuel must be made in order to properly lean the mixture to avoid fuel waste or possible engine flooding.

In conventional carburetors or fuel injection systems, the velocity of the air passing through a venturi portion assumed to correspond directly to the air mass flow. This assumption remains correct so long as there is no change in air density. If the ambient air temperature or pressure does change, then the resultant change in density invalidates this assumption and the carburetor or injection system experiences a change in air-fuel ratio. If the air density increases, then the air-fuel ratio becomes leaner and if the air density decreases, then the air-fuel ratio becomes richer. In most carburetor applications except aircraft the recent low cost of fuel has made mixture control not cost effective. In aircraft, where density-related mixture changes due to altitude result in large power reductions mixture control has always been a necessary feature.

The venturi system of measuring air flow and metering fuel is based upon the Bernoulli principle as expressed by the Bernoulli equation as follows:

$$\tfrac{1}{2}V^2+P/\rho=\text{Constant}$$

where P=Pressure, V=airflow velocity, $\rho$=air density. As the Bernoulli equation applies to air flow in a venturi, it can be rewitten as follows:

$$\tfrac{1}{2}(V_2^2-V_1^2)+[(P_2-P_1)/\rho]=0$$

or, $$\tfrac{1}{2}(V_2^2-V_1^2)=[(P_1-P_2)/\rho]$$

with the subscripts 1 and 2 referring to different axial locations in the flow tube. If the velocity at location 2 is high (such as occurs at the throat of a venturi) the pressure is lower than the pressure at a location where the velocity is low. From the Bernoulli equation, it is seen that the amount of pressure difference is much greater than the velocity difference because the velocities in the equation are squared.

The pressure that is sensed in a direction perpendicular to the direction of local flow in a venturi is the static pressure and is equal to that which would be sensed by a pressure instrument moving with the air flow. The pressure that is sensed by a probe inserted in the flow path and oriented with its opening facing the oncoming air is defined as the total pressure. The difference between the total pressure and the static pressure is the dynamic pressure and is related to the flow velocity by Bernoulli'equation as follows:

$$P_T-P_S=\tfrac{1}{2}\rho V^2$$

In the absence of friction, the total pressure remains constant along the length of a flow tube or venturi. In an area where the flow velocity increases due to a constriction in flow area, the static pressure is commensurately low.

Slide-type carburetors consisting of an air passage and a throttle plate movable to provide an adjustable throttle opening to alterably constrict the air passageway have been in existence for some time, as evidenced by U.S. Pat. Nos. 3,709,469 and 3,957,930. Such devices provide for throttling of the air flow in combination with mechanical control of the fuel quantities added to the carburetor. However, because fuel is injected into one side of the throttle opening in either of these devices, they suffer from an inability to supply a homogeneous air-fuel mixture across the throttle opening and do not permit a fuel range of air-fuel mixture control.

Other devices are known for metering fuel flow across the throat of a carburetor, as evidenced by U.S. Pat. Nos. 1,142,763 and 4,205,024. While such devices do permit fuel distribution effectively across the carburetor, it is difficult with such devices to adjust the air fuel mixture as the carburetor air passageway is throttled.

SUMMARY OF THE INVENTION

The present invention overcomes the above-delineated shortcomings of the prior art, and others, by providing an improved carburetor having a fuel metering system for supplying an adjustable, air-fuel mixture across the entire carburetor throttle opening, no matter whether the opening is practically closed or in a full throttle position.

The invention includes three basic components, an air passageway, a throttle valve having a throttle opening mounted to alterably constrict the air passageway and thereby control the cross-sectional dimension of the air passageway, and a fuel metering system for supplying required quantities of fuel to the air passageway for mixture with air passing therethrough.

The novel fuel metering system according to the invention incorporates a fuel metering tube which includes means for injecting fuel across the entire throttle opening. To achieve consistent fuel distribution, the fuel metering tube has a distribution outlet across the entire width of the throttle opening, no matter what size throttle opening is presented.

In response to adjustment of the throttle opening, the fuel metering system includes means to change the effective length of the fuel distribution outlet responsive to changes of the effective cross-sectional dimension of the air passageway. Finally, in a first embodiment of the invention, the fuel metering system includes means to alter the flow of fuel through the distribution outlet by changing the orientation of the fuel metering tube from a maximum lean position, where fuel flow may be essentially eliminated, to a full fuel position, thereby providing the richest possible air-fuel mixture.

In this first embodiment, in order to alter the flow of fuel through the fuel distribution outlet, the fuel metering tube preferably is rotatable about its longitudinal axis to change the circumferential location of the distribution outlet. The outlet is positionable at any location between a maximum lean condition facing upstream in the direction of air passage, and a maximum rich condition 90 degrees therefrom in which the distribution outlet faces across the path of air flow.

In a second embodiment of the invention, the fuel supply comprises a fixed metering tube having its distribution outlet extending along one side and oriented perpendicular to air flow through in throat of the carburetor. In order to control the fuel flow, a pressure detecting tube is located in communication with the air passageway to sense a portion of the dynamic pressure of the air as it passes through the carburetor. This detected pressure is then used to maintain the pressure of the fuel at the detected pressure as the fuel is introduced into the fixed metering tube.

In this second embodiment of the invention, the detecting tube has an inlet in one side and is very similar to the fuel metering tube of the first embodiment of the invention. The detecting tube is rotatable to change the circumferential location of the inlet and therefore change the amount of the dynamic air pressure that is sensed. Therefore, because of the rotatable nature of the detecting tube, the tube can be made to sense any pressure between the total pressure and the static pressure of the air flow.

In order to control the fuel flow in this embodiment of the invention, the invention includes a balancing regulator which is regulated by the sensed pressure. The balancing regulator has an inlet on one side for the fuel, and includes a control responsive to the sensed pressure and operable to permit the flow of fuel through the fuel inlet at such a rate so as to maintain equality between fuel pressure and the sensed pressure.

In another embodiment of the invention, the fuel metering tube is also fixed with the distribution outlet extending prependicular to the air flow. A pressure transmitting tube having one end extending into the air flow is oriented to detect the total pressure of the air. A second pressure transmitting tube has one end extending into the throttle passageway in order to detect the static pressure of the air passing therethrough. The tubes are joined at their other ends and a third pressure transmitting tube leads from this junction to a balancing regulator to control pressure of the fuel. The second pressure transmitting tube has a valve operable to permit a portion of the total pressure in the first pressure transmitting tube to bleed into the second pressure transmitting tube, leaving a resultant differential pressure in the third pressure transmitting tube. The resultant differential pressure is used to control the pressure of the fuel as it is introduced into the fuel outlet.

In this embodiment of the invention, a balancing regulator is again used to control the fuel flow. The balancing regulator senses the differential pressure and has an inlet for the fuel. The regulator includes a fuel control responsive to the sensed differential pressure and operable to permit flow of fuel through the fuel inlet at such a rate so as to maintain equality of pressure between the fuel and the sensed differential pressure.

In both latter embodiments of the invention, the fuel is delivered to the inlet of the balancing regulator from some external source such as a fuel pump or elevated fuel reservoir. The balancing regulator therefore is used to reduce the pressure of the fuel to the required pressure before fuel is permitted to enter the fuel metering tube.

The fuel metering tube extends across the throttle opening. In one form, the distribution outlet in the fuel metering tube comprises a plurality of apertures spaced axially along one side of the metering tube. In another form, the distribution outlet comprises an axial slot along one side of the metering tube.

In one form of the invention, the metering tube is positioned in registration with the throttle valve and extends through a complementary lateral aperture in the throttle valve. The throttle valve is slidable upon the metering tube to adjust the throttle opening and change the effective length of the fuel distribution outlet. In another form of the invention, the metering tube is attached to the throttle valve and extends into a complementary conduit. The conduit is fixed and closely fits the metering tube so that as the throttle valve is opened, the effective length of the fuel distribution outlet is increased. Therefore, in either form of the invention, no matter how large the throttle opening, a continuous distribution of fuel is maintained across the entire throttle opening.

The throttle valve is adjustable between limits to provide a maximum throttle opening and a minimum throttle opening. In order to precisely control the fuel-air mixture at the minimum throttle opening, the axial location of the fuel metering tube can be slightly adjusted. Thus, a greater or lesser portion of the distribution outlet can be presented across the throttle opening at its minimum setting.

Because the throttle valve is adjustable, in accordance with the Bernoulli equation above, as the throttle opening increases, the velocity decreases and therefore the static pressure increases. In all embodiments of the invention, the pressure of the fuel is maintained at or less than the air total pressure, and fuel flow from the fuel metering tube is governed by the static pressure. If the static pressure increases as the throttle is opened, the fuel flow decreases and the fuel-air mixture becomes leaner unless the effective size of the fuel opening of the fuel tube increases to maintain a constant fuel-air mixture. Thus, in all embodiments of the invention, as the throttle opening increases and the static pressure thus increases, provision is made in the fuel tube to increase the amount of fuel discharging to offset the static pressure increase.

BRIEF DESCRIPTION OF THE DRAWINGS

The above features of the invention, and others, are described in greater detail in the following description of the preferred embodiments, taken in conjunction with the drawings, in which:

FIG. 4 is a view similar to FIG. 2 but with the throttle valve being withdrawn sufficiently to provide a full throttle opening.

DESCRIPTION OF THE PREFERRED EMBODIMENTS

Figure 1:
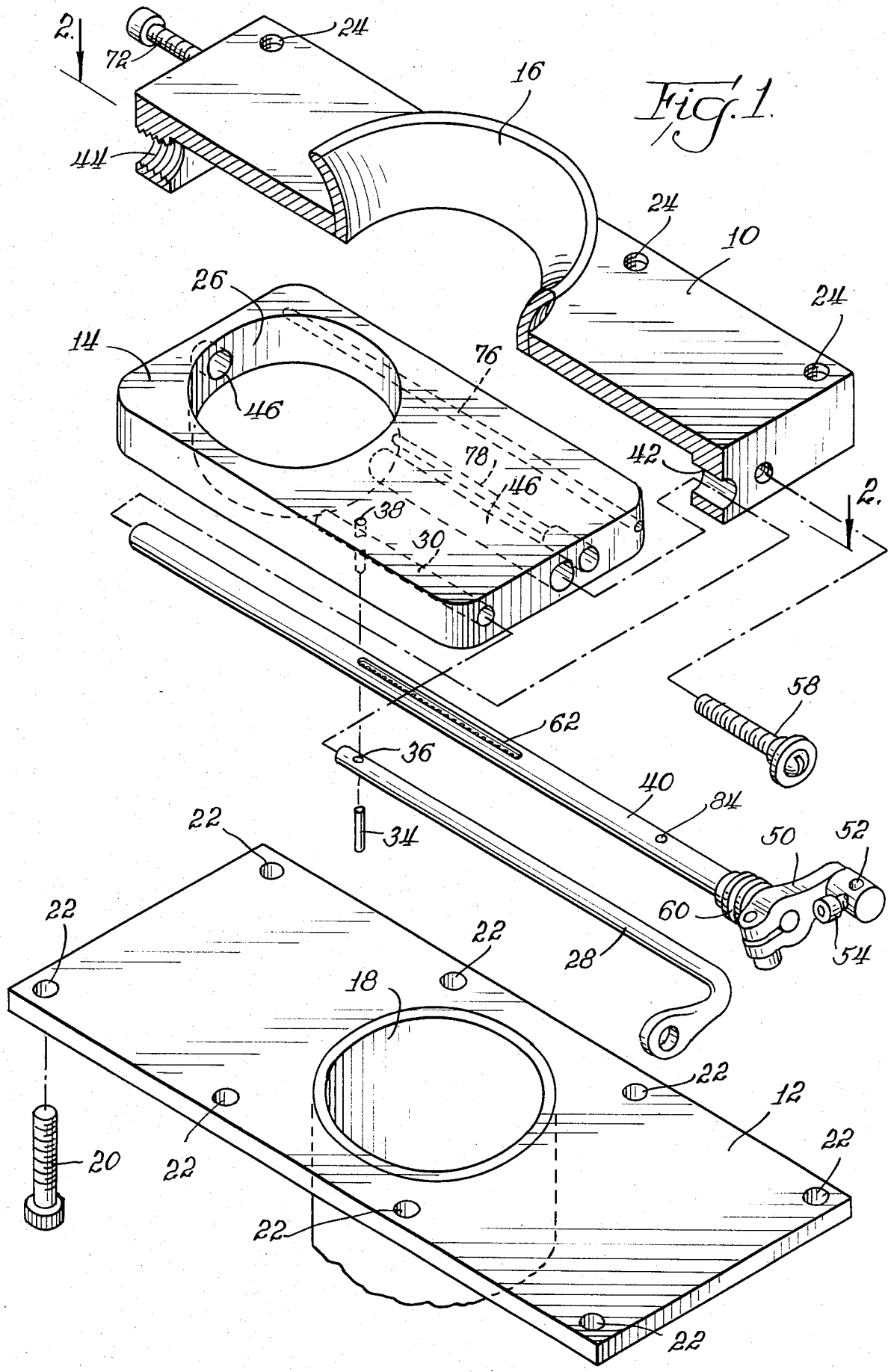
FIG. 1 is an exploded illustration of the invention, with some parts omitted and other parts in cross section to permit illustration of the primary components of the invention.

A fluid mixing device according to the invention, in the form of a carburetor, is shown in assembly fashion in FIG. 1. Primary components of the carburetor include a top plate 10, a bottom plate 12, and a throttle valve 14. Although the top plate 10 and bottom plate 12 are delineated as such, it should be obvious that the designations "top" and "bottom" are for the purposes of explanation only, and the respective roles of the plates 10 and 12 can be reversed as necessary. In addition, the top plate 10 has been shown in cross section for the purposes of description, and would include a second half complementary to that shown in FIG. 1.

The top plate 10 includes an air inlet 16. The bottom plate 12 includes an air-fuel outlet 18 located in concentric registration with the air inlet 16. The inlet 16 and outlet 18 are preferably of equal diameter.

When the carburetor is assembled, the throttle valve 14 is sandwiched between the top plate 10 and the bottom plate 12 for sliding movement between the two plates. The plates 10 and 12 are suitably fixed together as by means of a plurality of screws 20 passing through apertures 22 in the bottom plate 12 and engaging corresponding threaded apertures 24 in the top plate 10.

Although, as indicated above, the throttle valve 14 is situated between the plates 10 and 12 for sliding movement, the throttle valve 14 is dimensioned for a close fit in the aperture formed between the plates 10 and 12 when assembled. The throttle valve 14 may be formed of a material susceptible to forming a seal, such as Teflon, while the plates 10 and 12 may be formed of aluminum, steel or other relatively stiff material. Other materials may be used as desired.

As best shown in FIG. 1, the throttle valve 14 includes a throttle opening 26. The cross-sectional dimension of the opening 26 is the same as the diameters of the inlet 16 and outlet 18 so that if the inlet 16, opening 26 and outlet 18 are aligned, a constant diameter bore is formed through the carburetor. At this position, as described in greater detail below, air flow is maximum and, as is well known, the carburetor is at its full throttle position.

Figure 2:
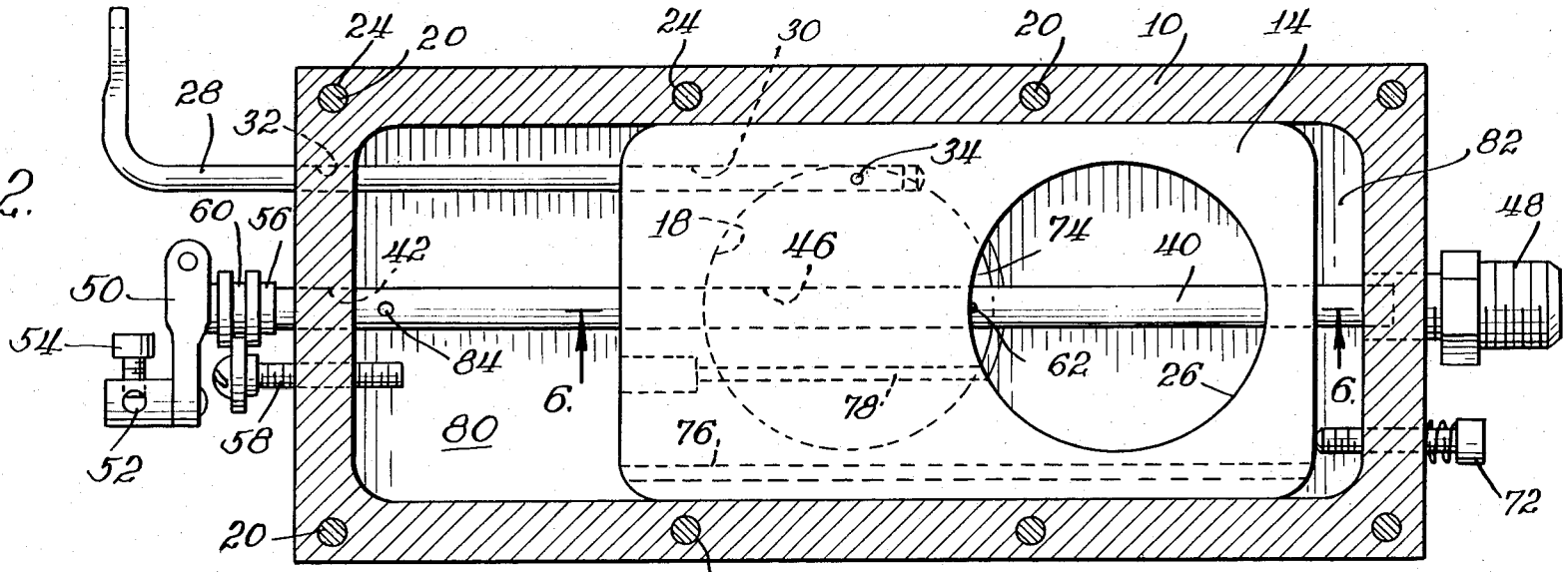
FIG. 2 is a cross-sectional illustration of the assembled invention, illustating the throttle valve closed to a minimal throttle opening.
Figure 3:
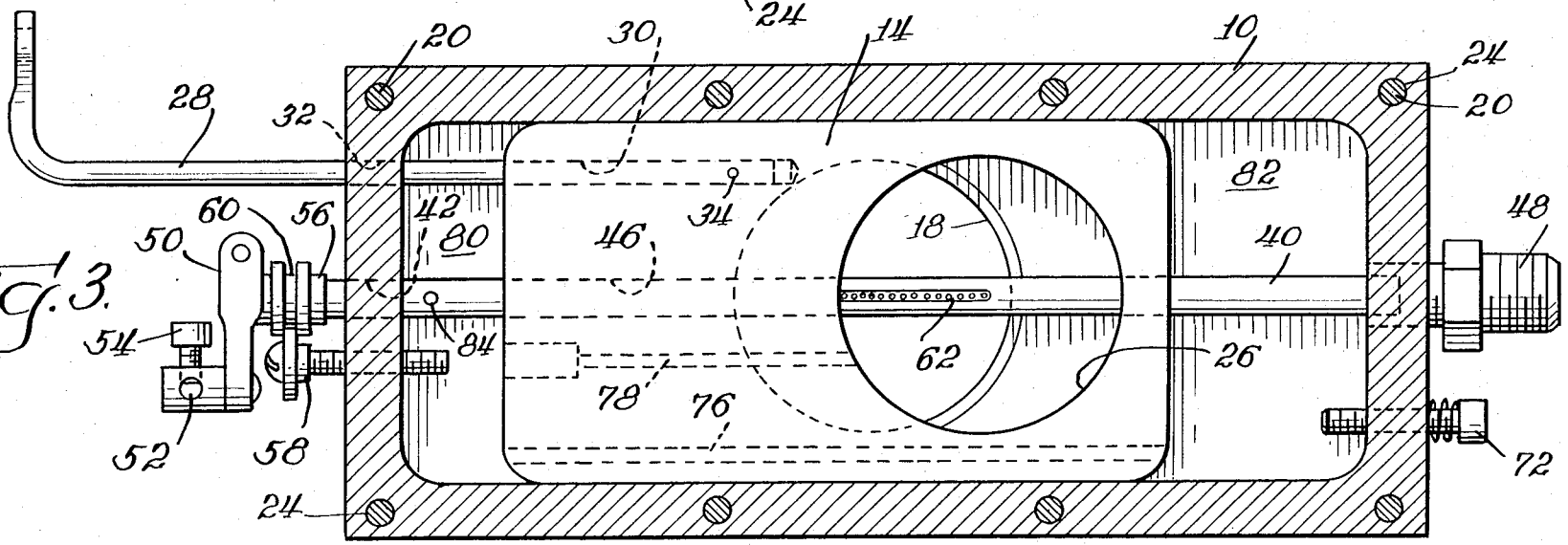
FIG. 3 is an illustration similar to FIG. 2, but with the throttle valve translated sufficiently to provide a partial throttle opening.

As best shown in FIGS. 2 through 4, the position of the throttle valve 14 between the sandwiched plates 10 and 12 is determined by means of a control rod 28. The rod 28 is secured within a bore 30 formed in the throttle valve 14 and passes through an aligned aperture 32 formed in the sidewall of the top plate 10. A pin or set screw 34, passing through a hole 36 in the rod 28 and lodged within a hole 38 formed in the throttle valve 14, secures the control rod 28 within the throttle valve 14.

For fuel metering, the carburetor includes a fuel metering tube 40 which passes longitudinally through the entire throttle valve 14 and extends through aperture 42 and into aperture 44 at opposite ends of the top plate 10. The throttle valve 14 includes a close-fitting longitudinal aperture 46 through which the fuel metering tube 40 passes and upon which the throttle valve 14 is mounted for sliding between the extreme locations shown in FIGS. 2 through 4. The longer bore of the longitudinal aperture 46 may include sealing rings or the like (not illustrated) to assure a fluid-tight seal between the fuel metering tube 40 and the aperture 46.

The aperture 44 is threaded, as illustrated. A fuel connection nipple 48 is engaged on the threads of the aperture 44 and is shaped for connection to an external fuel source (not illustrated) in a well-known manner not further described herein. The fuel connection nipple 48 may include a sealing ring or some similar device to provide a fluid tight seal between the nipple 48 and the fuel metering tube 40.

The fuel metering tube 40 is rotatable about its longitudinal axis to control the fuel-air ratio. Rotation is controlled by means of an arm 50 attached to the end of the fuel metering tube 40 opposite to that of the connection nipple 48. The arm 50 sealingly closes the tube 40 at its point of connection, and is controlled for rotation by suitable means (not illustrated), such as a control cable which may be clamped to the arm 50 through a bore 52 by a bolt 54.

Immediately adjacent the arm 50, a collar 56 is permanently secured to the fuel metering tube 40. A keeper screw 58, threadedly secured within the top plate 10, engages a circumferential channel 60 formed in the collar 56. Thus, the keeper screw 58 maintains precise axial alignment of the fuel metering tube 40. By suitable adjustment of the keeper screw 58, the axial position of the fuel metering tube 40 may be altered for purposes described in greater detail below.

As best shown in FIGS. 1 and 4, the fuel metering tube 40 includes a distribution outlet 62 extending across the entire width of the throttle opening 26 when the throttle valve 14 is in the full throttle position. Thus, with the axial alignment of the fuel metering tube 40 being fixed by the keeper screw 58, no matter what the position of the throttle valve 14 between the top and bottom plates 10 and 12, fuel is dispensed across the entire width of the effective throttle opening.

Figures 5, 8, 9, 10A, 10B, 11:
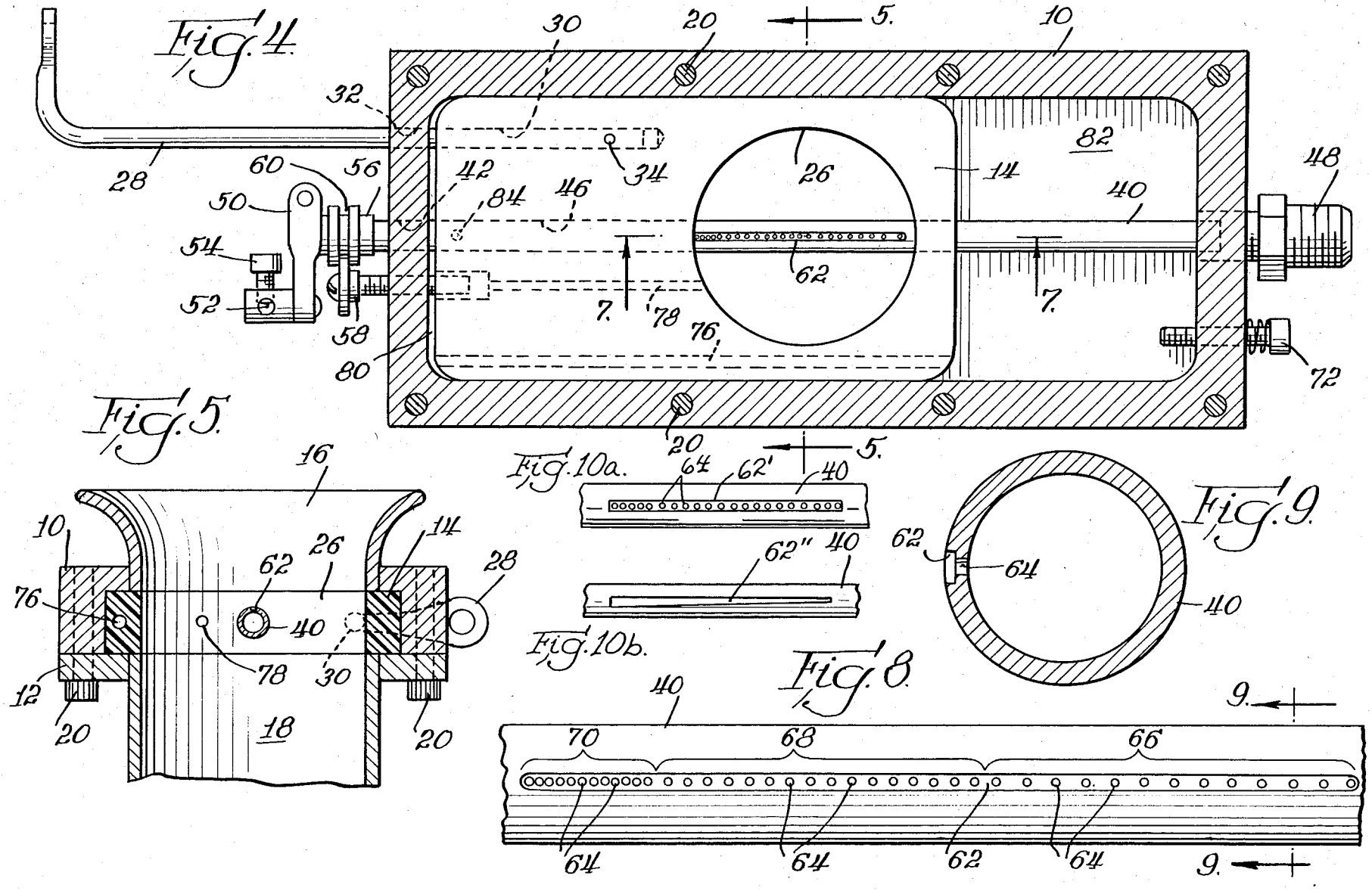
FIG. 5 is an enlarged cross-sectional illustration taken along lines 5—5 of FIG. 4.
FIG. 8 is an enlarged, partially truncated view of one embodiment of the fuel metering tube according to the invention.
FIG. 9 is an elongated cross-sectional illustration taken along lines 9—9 of FIG. 8.
FIG. 10*a* is a truncated top plan view of an alternative embodiment of the fuel metering tube according to the invention.
FIG. 10*b* is a truncated top plan view of another alternative embodiment of the fuel metering tube.
FIGS. 11 through 13 illustrate rotation of the fuel metering tube respectively between a lean mixture setting, and a rich mixture setting.

As shown in enlarged fashion in FIGS. 8 and 9, in one embodiment, the distribution outlet 62 is composed of a plurality of holes 64 spaced axially along one side of the fuel metering tube 40. The holes 64 have been gathered in three groups 66, 68 and 70 in order of decreasing hole spacing (the spacing within each group being constant). The groups of holes are uncovered in order of increasing hole concentration as the throttle valve 14 is opened. That is, as the throttle valve 14 is progressively opened to increase the effective cross section of the throttle opening, the holes 64 of group 66 first appear, then the holes 64 of the group 68, then the holes 64 of the group 70 until, when the throttle valve 14 is opened to the position shown in FIG. 4, all holes 64 of the three groups 66, 68 and 70 are exposed.

As the effective cross-sectional dimension of the throttle opening increases, then, as explained above in relation to the Bernoulli equation, the flow velocity decreases and the static pressure increases (since the total pressure remains constant). Since the fuel flow is dependent upon the static pressure, as the static pressure increases, the fuel flow rate decreases. Thus, the spacing of the holes 64 must decrease and the hole concentration increase as the throttle valve 14 opens in order to maintain the proper air-fuel ratio. FIG. 8 illustrates one manner of increasing the hole concentration by increasing fuel flow in steps by using the groups 66 through 70 of increasing hole concentration.

In order to maintain as constant an air-fuel ratio as possible, preferrably the hole concentration should increase not in steps, but uniformly as the throttle valve 14 is opened. FIG. 10*a* illustrates another embodiment of the invention where the spacing between adjacent holes 64 of a distribution outlet 62' decreases from right to left (in the direction of opening of the throttle valve 14). The outlet 62' is thus non-uniform, and as the static pressure increases by further opening of the throttle valve 14, additional holes 64 provide a greater fuel outlet to compensate for a decreased fuel flow rate due to increased static pressure. To achieve the same result, the holes can also increase in size.

Figure 18:
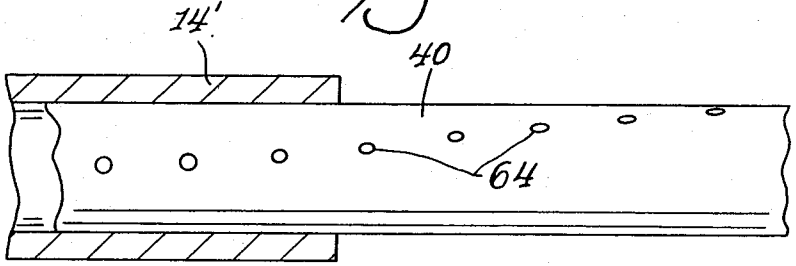
FIG. 18 is a partial side elevational illustration, partly in cross-section, of another embodiment of the fuel metering tube according to the invention.

The holes 64 of the distribution outlet 62 or 62' need not be located in a straight line parallel to the axis of the tube 40. As shown in FIG. 18, the holes 64 may be formed in a helical fashion with the holes located at different circumferential locations such that as the throttle valve 14' is opened, the last hole or holes to be exposed are circumferentially positioned at different angles from earlier exposed holes to sense a smaller percentage of the dynamic pressure and thereby cause the last-exposed holes to dispense a greater volume of fuel than the first exposed holes.

FIG. 10*b* illustrates an alternative embodiment of the distribution outlet, designated as 62''. In this embodiment, the holes 64 are eliminated and instead the distribution outlet 62' comprises an axial slot opening along one side of the metering tube 40. In the same manner as grouping of the holes 64 in the distribution outlets 62 or 62', since there is an increase of the static pressure as the throttle valve 14 is opened, the slot of the distribution outlet 62'' may be formed in an increasing taper fashion, as illustrated, in order to increase the fuel outlet area through the distribution outlet 62'' to offset the increased static pressure.

Figure 19:
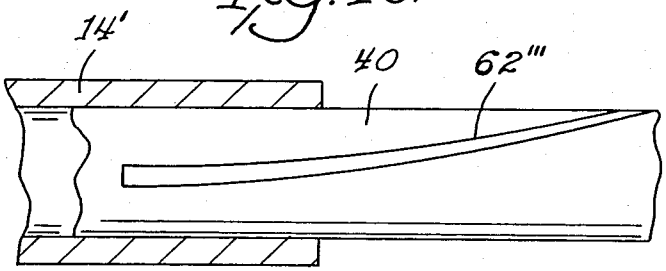
FIG. 19 is a partial side elevational illustration, partly in cross-section, of yet another embodiment of the fuel metering tube according to the invention.

The distribution outlet 62'' also need not be straight. As shown in FIG. 19, an outlet 62''' may be formed in a helical fashion such that the portion of the outlet 62''' last exposed is circumferentially positioned at a different angular location from that earlier exposed to sense a smaller percentage of the dynamic pressure and thereby cause the last-exposed portion of the outlet 62''' to dispense a greater volume of fuel than that portion first exposed.

The fuel distribution outlet 62 may take other forms, depending on the fuel distribution characteristics desired. A series of two or more circumferentially spaced outlets can be used, and holes or slots for fuel distribution can be used in combination, or can be replaced by equivalent outlet means. As an alternative, the distribution outlet 62 may follow other than the patterns previously described in order to alter fuel metering capabilities along its length.

Figure 7:
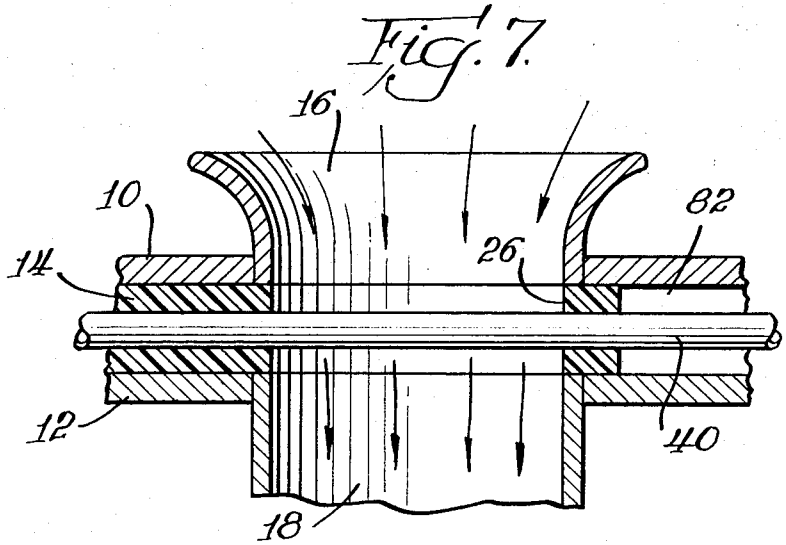
FIG. 7 is an enlarged cross-sectional illustration taken along lines 7—7 of FIG. 4.
Figure 6:
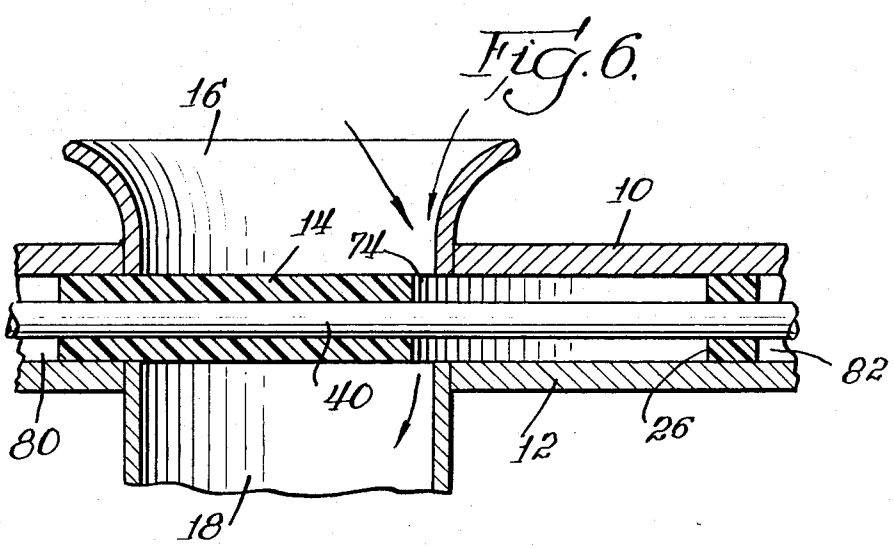
FIG. 6 is an enlarged cross-sectional illustration taken along lines 6—6 of FIG. 2.

As is well known, depending on the position of the throttle valve 14 and therefore the cross-sectional dimension of the air passageway through the carburetor, air flow through the carburetor is controlled. With the throttle valve 14 in the position illustrated in FIGS. 4, 5 and 7, maximum air flow is permitted and therefore the carburetor is at full throttle. With the throttle valve 14 at the position indicated in FIGS. 2 and 6, the carburetor is at its throttle closed position. The location shown in FIG. 3 is a mid-throttle position. As shown in FIG. 2, the maximum closure of the throttle valve 14 is determined by a set screw 72. With the set screw 72 adjusted to the position shown in FIG. 2, a minimum air passageway 74 is formed. As shown in the drawings, the dimension of minimum air passageway 74 can be increased or decreased as desired by adjustment of the set screw 72. In fact, if desired, the minimum air passageway 74 can be omitted completely although such a situation is not normally acceptable.

Also as shown in FIG. 2, only a very small portion of the distribution outlet 62 extends into the minimum air passageway 74. If desired, a greater portion of the distribution outlet can extend into the minimum air passageway 74 by adjustment of the keeper screw 58. Assuming that, in the position shown in FIG. 2, a single hole 64 (FIG. 8) of the distribution outlet 62 extends into the minimum air passageway 74, by suitable adjustment of the keeper screw 58, a greater portion of the distribution outlet 62 can appear in the minimum air passageway 74, allowing one or more additional holes 64 to inject fuel into the minimum air passageway. Thus, by adjustment of the set screw 72 and the keeper screw 58, the dimensions of the minimum air passageway 74 are dictated, and also the fuel metering capacity at this minimum setting is determined.

In many carburetors, such as an aircraft carburetor of the nature of the invention, fuel pressure entering the carburetor fuel metering section is essentially equal to ambient pressure. Therefore, fuel is aspirated from the distribution outlet 62 of the fuel metering tube 40 by pressure differences created within the throttle passageway. In many situations, and in particular in an aircraft, the carburetor must have the capability of reducing the fuel flow as increases in aircraft altitude reduce the density of the air entering the air inlet 16 of the carburetor. Changes in the air-fuel mixture are effected by rotation of the fuel metering tube 40, as best shown diagrammatically in FIGS. 11 through 13. With the fuel metering tube 49 in the position shown in FIG. 11, the distribution outlet is aimed upstream directly toward the air inlet 16, and the carburetor is in the "idle cutoff" position. When the fuel pressure in the metering tube is regulated in such a way so as to be maintained approximately equal to the total pressure of the air, the dynamic air pressure within the air inlet 16 completely inhibits the flow of fuel, causing the engine to stop.

Figure 13:
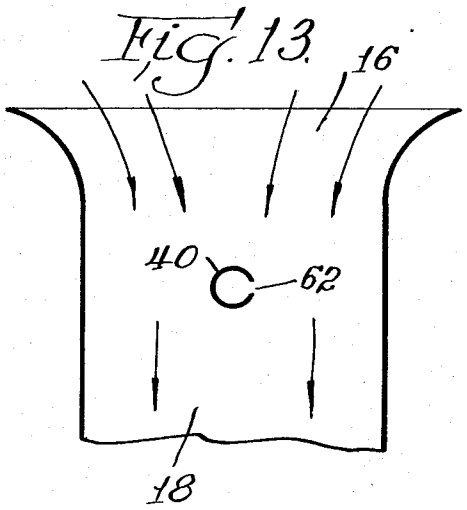

In the position shown in FIG. 13, the distribution outlet 62 is turned at 90 degrees to the airflow. This is the position for providing the richest possible air-fuel mixture such as is normally required at low altitudes. In this position, the fuel flow from the distribution outlet is being aspirated into the air passageway by the difference in pressure between the fuel inside the fuel metering tube 40 and the static air pressure outside of the distribution outlet 62 which is reduced below ambient pressure in accordance with the Bernoulli equation.

Figure 12:
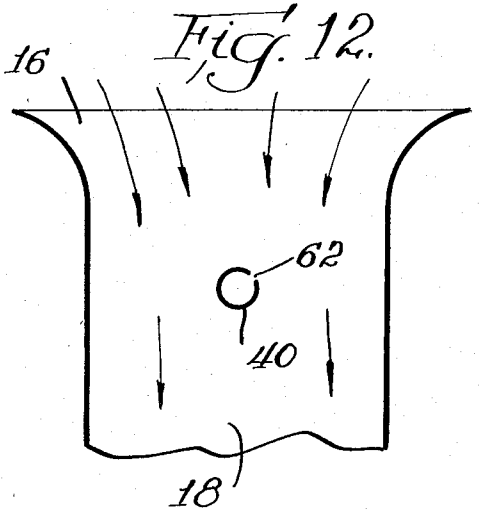
Figure 11:
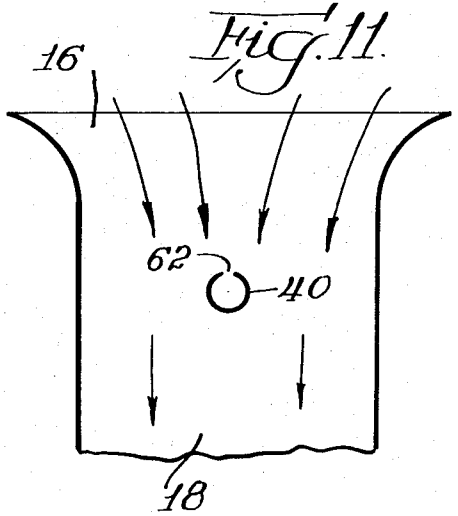

To adjust the carburetor to a leaner air-fuel mixture as would be required at higher altitudes, the fuel metering tube a40 is rotated to a mid-way orientation such as that shown in FIG. 12. In this position, the air pressure outside of the fuel distribution outlet 62 is increased by a dynamic component of the velocity of the air entering the air inlet 16. This reduces the differential between the static and dynamic pressures which aspirates the fuel from the distribution outlet 62, and therefore reduces the fuel flow rate from that of the orientation shown in FIG. 13. Consequently, a leaner fuel mixture is attained without fuel flow cutoff as shown in FIG. 11.

Therefore, the invention achieves a consistent fuel distribution with precise air-fuel mixing to enable the carburetor to control an engine no matter what ambient conditions may be encountered. Not only does the throttle valve 14 control the air flow through the carburetor, but also the throttle valve, when sliding along the fuel metering tube 40 across the distribution outlet 62, maintains the air-fuel mixture essentially constant no matter what the throttle position, contrary to conventional carburetors. In addition, by rotation of the fuel metering tube 40, the richness of the air-fuel mixture can be precisely controlled to account for changes in ambient air density.

Although normally unnecessary with the present invention, in some internal combustion engines it may be necessary to inject additional fuel into the throttle opening 26 during periods of engine acceleration. Because fuel is available directly at the outlet 62, acceleration enrichment is not normally required with the present invention. If desired, however, the throttle valve 14 may include bores 76 and 78. Normally, as shown in FIG. 2, a reservoir 80 formed between the plates 10 and 12 is flooded with fuel. If the throttle valve 14 is opened rapidly during a period of high acceleration, some of the fuel in the reservoir 80 will pass through the bore 78 and be emitted directly into the throttle opening 26. The remainder thereof will pass through the larger bore 76 into a second reservoir 82 on the opposite side of the throttle valve 14. The more rapidly the throttle valve is opened (right to left in FIGS. 2 through 4), the greater the quantity of fuel which is forced through the bore 78 into the throttle opening 26. On the other hand, if the throttle valve 14 is withdrawn at a slow rate, very little, if any, fuel passes through the bore 78, the majoirty thereof passing through the bore 76 into the newly-formed reservoir 82. Thus, during periods of high acceleration, an additional quantity of fuel can be injected into the throttle opening 26.

An alternate method is available to provide acceleration enrichment if the fuel metering tube 40 is provided with a fuel bleed orifice 84 in substitution for the bore 78. In this configuration, a sudden throttle movement leftward causes the throttle plate 14 to force the fuel contained in the reservoir 80 through the bleed orifice 84 into the metering tube 40 and out of the distribution outlet 62 into the throttle opening 26.

Figure 14:
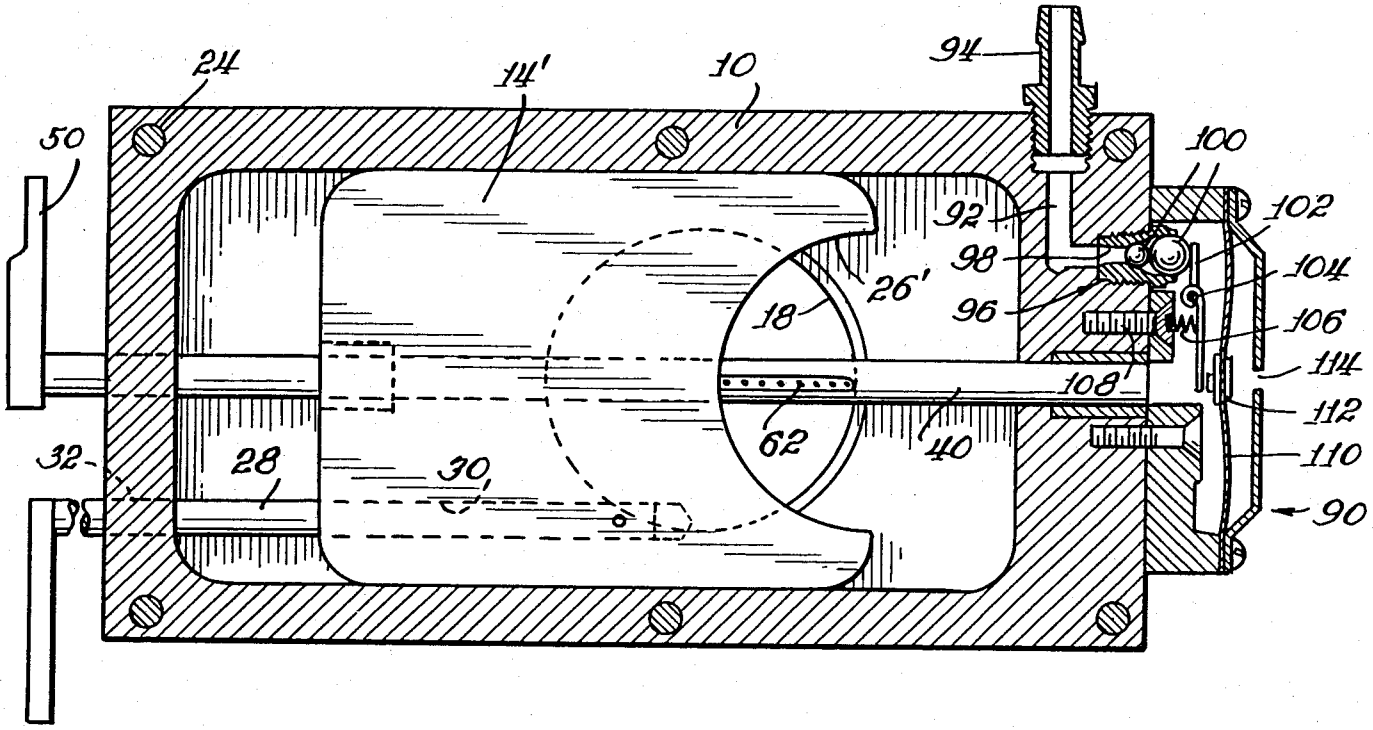
FIG. 14 illustrates, in cross section, a modified embodiment of the invention.

FIG. 14 illustrates an alternative embodiment of the invention having modification of the throttle valve and fuel system leading to the fuel inlet tube 40. Other components of the invention remain the same and therefore bear the same reference numerals. Since these elements were described above, further description is omitted.

As illustrated, the throttle valve 14' in FIG. 14 is truncated, omitting a portion of the throttle valve 14 which is unnecessary. As shown, the throttle valve 14' includes a throttle opening 26' having a diameter equal to that of the air-fuel mixture outlet 18 so that, in a full throttle open position (such as that illustrated in FIG. 4), there is no obstruction to flow by the throttle valve 14'.

In this embodiment, the invention includes one form of a balancing regulator 90 operable to maintain fuel pressure in the fuel inlet tube 40 at ambient pressure. The balancing regulator 90 has an inlet 92 for fuel under pressure. The inlet 92 leads to a nipple 94 which may be connected to a source of fuel (not illustrated).

The inlet 92 is terminated by a fluid control ball valve 96 or by a conventional needle valve and seat assembly (not illustrated). The valve 96 has an internal orifice 98 which may be closed by a pair of balls 100. An arm 102, pivotally connected in its mid-section at 104 to the balancing regulator 90, has one end which bears against the larger of the balls 100. The other end of the arm 102 bears against a biasing compression spring 106 which in turn bears against a screw 108 threaded into the body of the plate 10. Depending on the compression strength of the spring 106, the spring normally pivots the arm about the pivot 104, urging the balls 100 into the orifice 98 to preclude fuel flow through the inlet 92 into the interior of the balancing regulator 90 and from there into the fuel inlet tube 40. Fine adjustment of the compression strength of the spring 106 with the screw 108 to achieve this end is well-known.

The balancing regulator 90 also includes a movable diaphragm 110 having a central contact 112 in alignment with one end of the arm 102. The balancing regulator 90 also includes an opening 114 to the ambient surroundings.

The metering system of the balancing regulator 90 operates in a well-known manner. Since the opening 114 is to the ambient pressure which is usually equal to the airflow total pressure, the ambient pressure normally urges the contact 112 against the arm 102, permitting fuel to enter the regulator 90 through the inlet 92. Not only does the entering fuel flow through the fuel inlet tube 40 and exit through the distribution outlet 62, the fuel also bears against the opposite side of the diaphragm 110 from that open to the ambient pressure experienced through the opening 114. If the fuel pressure is higher than the ambient pressure, the increased pressure of the fuel tends to urge the contact 112 away from the arm 102, permitting the spring 106 to pivot the arm about the pivot 104, urging the balls 100 into the closed position. Therefore, the diaphragm 110 always positions itself as necessary to substantially equalize the fuel pressure on the fuel side of the diaphragm with the ambient air pressure on the air side of the diaphragm. Thus, the fuel pressure in the inlet tube 40 is always maintained at approxiamtely the same pressure as the ambient air pressure surrounding the carburetor.

Figures 15, 15A, 15B, 15C:
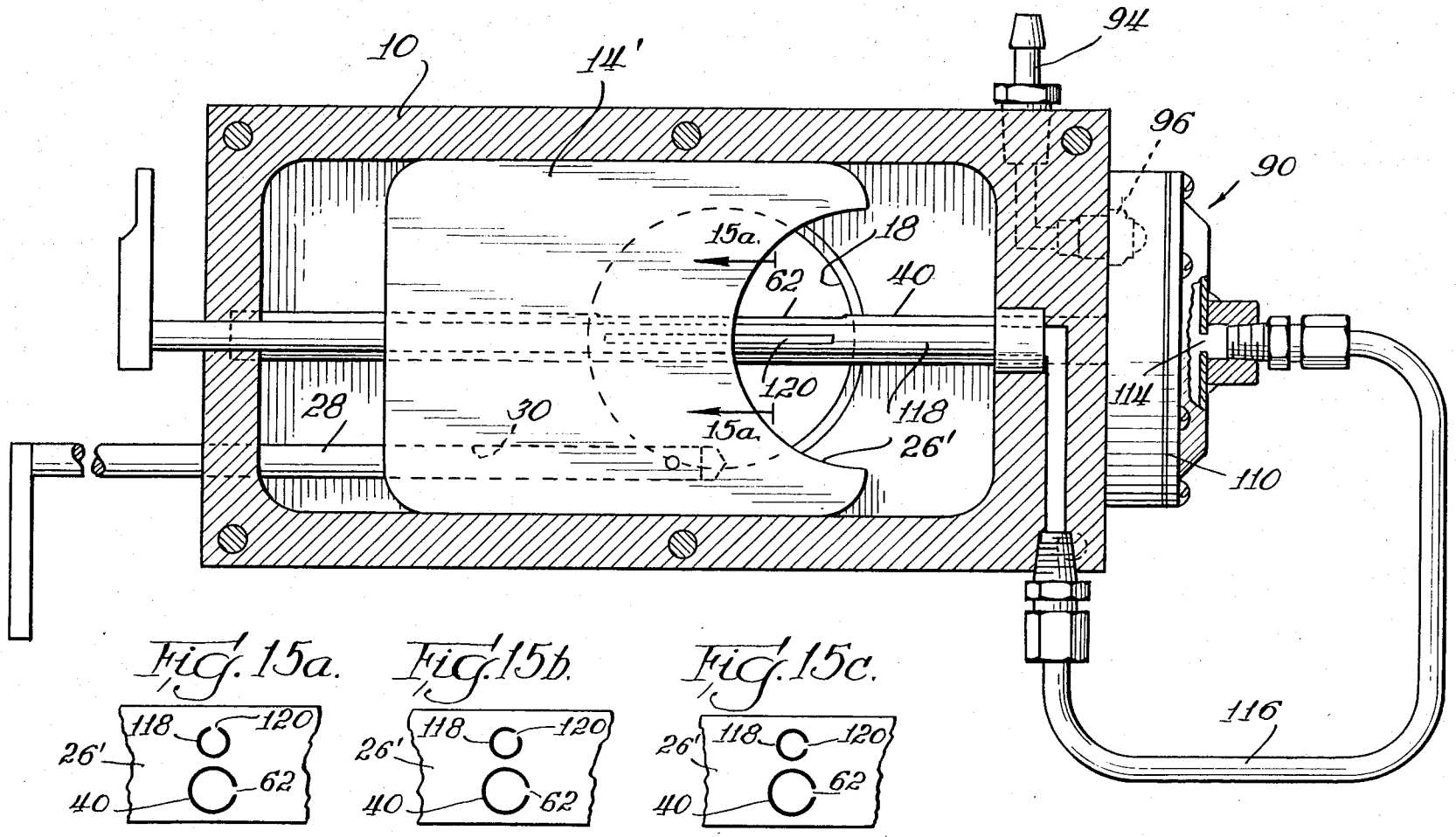
FIG. 15 illustrates a modification of the embodiment of FIG. 14, showing another form of the fuel metering system.
FIGS. 15*a* through 15*c* illustrate a partial cross section taken along lines 15*a*—15*a* of FIG. 15, with FIGS. 15*b* and 15*c* showing rotation of the pressure detecting tube.

FIG. 15 illustrates a modified version of the invention in which fuel flow is controlled totally by air pressure and the fuel inlet tube 40 is fixed with the inlet 62 oriented so as to sense static pressure, in this embodiment perpendicular to the direction of air flow through the carburetor.

As seen in FIG. 15, the opening 114 of the balancing regulator 90 is not opened to ambient pressure. Rather, a conduit 116 leads from the opening 114 to a pressure detecting tube 118 extending across the air inlet 16. The tube 118 must be immediately adjacent the fuel distribution outlet 62, and is shown directly above the tube 40 in FIG. 15. The detecting tube 118 includes an aperture 120 therein, thus permitting the tube 118 to sense the air pressure in the air inlet 16. The tube 118 is axially rotatable as shown in FIG. 15 and in FIGS. 15*a*–15*c* in order to permit altering the circumferential location of the aperture and therefore vary the percentage of the dynamic pressure that is sensed.

Since the distribution outlet 62 of the fuel inlet tube 40 is fixed at an orientation perpendicular to the air flow through the carburetor, the distribution outlet 62 experiences only the static component of the total air pressure in the carburetor at its particular location. So long as the fuel introduced into the inlet tube 40 is at a pressure greater than the static pressure existing at the distribution outlet 62, fuel will flow from the distribution outlet and be mixed with the incoming ambient air.

The pressure balancing function of the balancing regulator 90 causes the pressure in the metering tube 40 to be substanntially equal to the pressure sensed by the pressure detecting tube 118. With the orientation of the aperture 120 shown in FIG. 15 and FIG. 15*a* (open to the air flow), the aperture 120 detects the total pressure of the air at this location. The balancing regulator adjusts the fuel pressure in the metering tube 40 to equal the total pressure sensed by the aperture 120. Since the pressure at the fuel outlet 62 is equal to the static pressure, fuel flow occurs through the fuel outlet 62.

If, on the otherhand, the aperture 120 is oriented as shown in FIG. 15*b*, the aperture 120 senses a lower pressure that is equal to the static pressure plus a lesser dynamic component that depends on the upstream orientation of the aperture 120. This lower pressure is transmitted through the conduit 116 to the diaphragm 110. The diaphragm 110 positions itself such that the ball valve 96 admits fuel to the fuel side of the diaphragm 110 at such a rate so as to make the fuel pressure in the metering tube 40 equal to the air pressure sensed by the aperture 120 in the pressure detecting tube 118.

When the pressure sensing aperture is oriented as shown in FIG. 15*c*, the resulting pressure in the fuel metering tube 40 is equal to the static pressure existing at the outlet 62. With the orientation shown in FIG. 15*c*, no fuel would flow.

Figure 16:
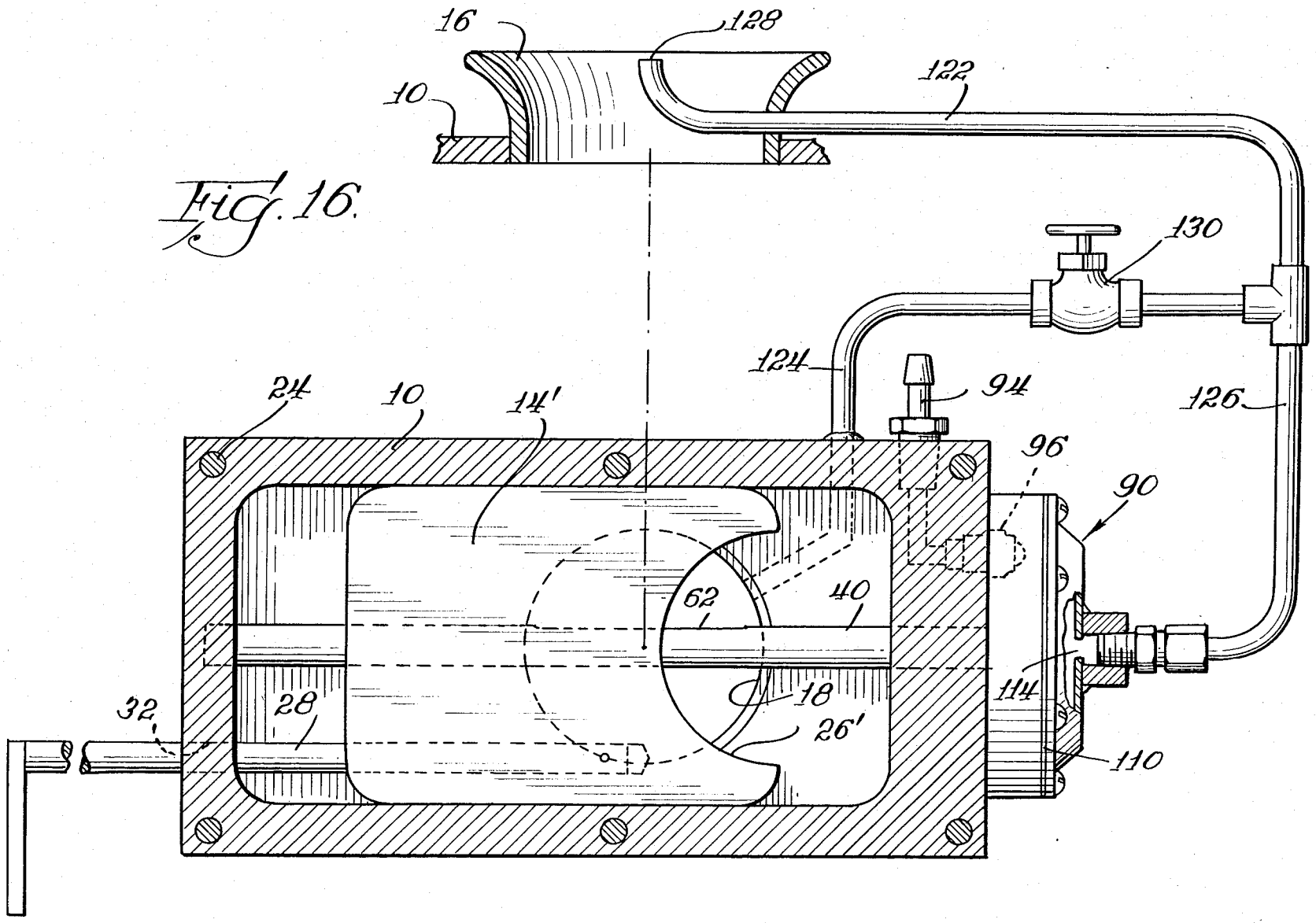
FIG. 16 illustrates a further modification of the embodiment of FIG. 14, showing yet another form of the fuel metering system.

Fig. 16 illustrates a modification of the system for injecting fuel into the carburetor. A portion of the air inlet 16 of the top plate 10 is shown superimposed above the cross-sectional illustration of the carburetor as depicted and described in FIG. 14. In this embodiment, a first pressure transmitting tube 122 leads from the air inlet 16 and joins a second pressure transmitting tube 124 leading from the mixture outlet 18. A third pressure transmitting tube 126 leads from the juncture of the tubes 122 and 124 to the opening 114 of the balancing regulator 90. As shown, the end 128 of the tube 122 in the air inlet 16 faces upstream nd therefore senses the total air pressure in the air inlet 16. The tube 124 is introduced at the side of the mixture outlet 18, and therefore detects the static pressure at that location. An adjustable needle valve 130 is located in the tube 124 and may be adjusted to close the tube 124 completely, or permit any opening required.

Because the end 128 of the tube 122 is opened to the total pressure, and because the tube 124 is opened to the lower static pressure, if the needle valve 130 is opened slightly, a portion of the total pressure in the tube 122 is bled through the needle valve 130 into the tube 124. This leaves a resultant differential pressure in the tube 126, which is directed through the opening 114 to the interior of the balancing regulator 90. Thus, by judicious adjustment of the needle valve 130, the differential pressure experienced by the balancing regulator 90 may be adjusted as desired. Since the distribution outlet 62 of the fuel inlet tube 40 is oriented perpendicular to the flow direction, and therefore experiences only the static pressure of the flow, the balancing regulator 90 is operated as described above and fuel is driven through the outlet 62 by the difference between the differential pressure within the tube 126 and the static pressure at the distribution outlet 62. So long as the differential pressure is greater than the static pressure, fuel will flow.

Figure 17:
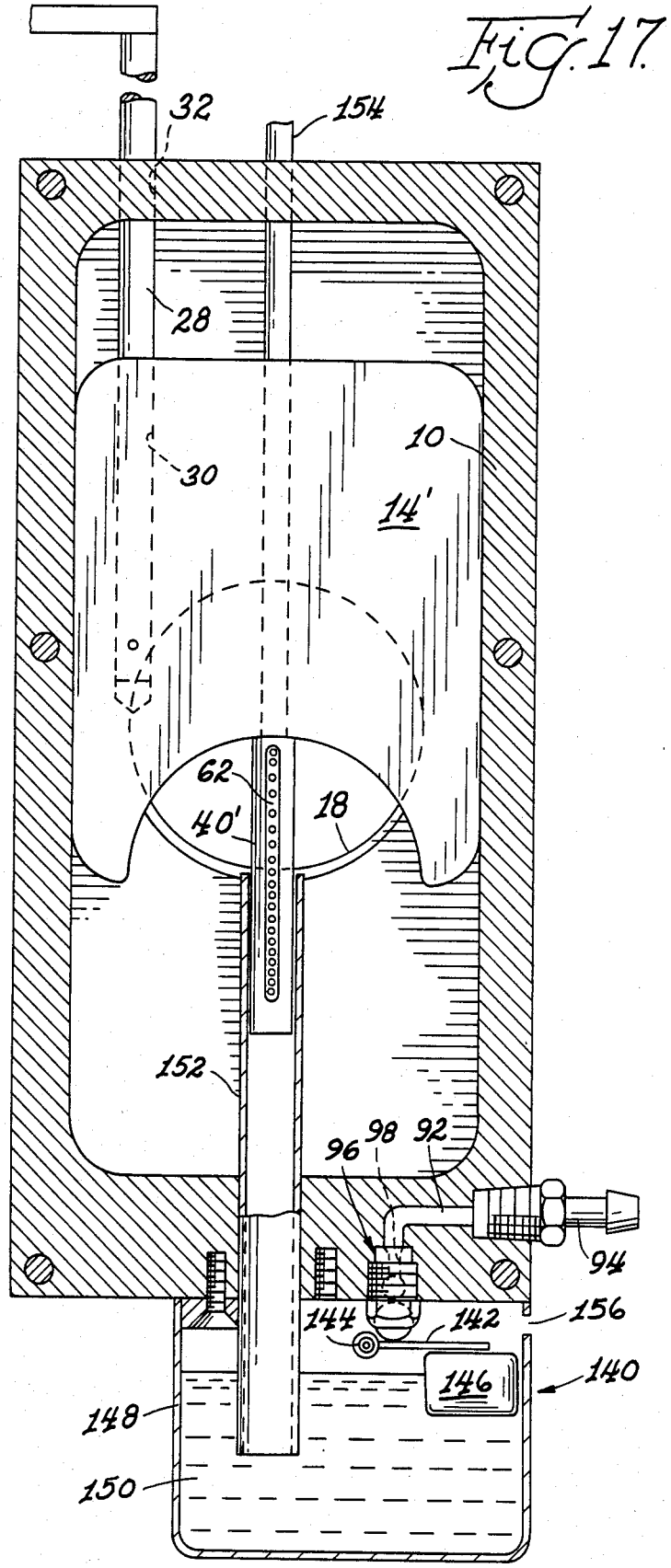
FIG. 17 illustrates a further modification of the embodiment of FIG. 14, showing a final form of the fuel metering system.

FIG. 17 illustrates another embodiment of the invention having modification of the throttle valve and fuel system leading to the fuel inlet tube 40. Components which have been described above bear the same reference numerals and perform the same functions. Further description, therefore, is omitted.

In this embodiment, the invention includes a fuel metering float regulator 140 operable to maintain constant fuel pressure at the inlet to a fuel conduit 152. The float regulator 140 includes the fluid control ball valve 96 and associated components described above. The arm 102 of the prior embodiments of FIGS. 14 through 16 is replaced with an arm 142 which is pivotally connected at one end at 144. The mid-section of the arm 142 bears against the larger of the balls 100. The other end of the arm 142 is connected to a float 146 maintained within a fuel reservoir 148 of the float regulator 140. The float 146 is situated such that during normal operation, the level of the fuel 150 within the fuel reservoir 148 is sufficient to allow fuel to enter the fuel conduit 152.

The conduit 152 extends to the outlet 18 and is shown partially in cross-section to aid in description. The fuel inlet tube 40′, which is attached to and moveable with the throttle valve 14, extends into the conduit 152. The tolerance between the tube 40′ and conduit 152 is maintained so that no fuel can leak between the outer wall of the tube 40′ and the inner wall of the conduit 152. As can be seen, as the throttle valve 14′ is opened (upward in FIG. 17), a greater portion of the distribution outlet 62 is exposed, thus permitting increased fuel flow. The tube 40′ may be rotated, when desired, by means of a rod 154 extending to an unillustrated rotational device.

In a similar fashion to previous embodiments of the invention, if the air pressure at the distribution outlet 62 is less than the sum of the fuel pressure at the inlet to the conduit 152 plus the static head resulting from the vertical distance between the level of the fuel 150 and the outlet 18, the fuel 150 will flow from the distribution outlet. Conversely, if the air pressure at the outlet 62 is the same as or higher than this sum, no fuel will flow from the distribution outlet 62. Normally, the static head pressure resulting from the height difference between the outlet 18 and the level of the fuel 150 is insignificant compared to the air pressure at the outlet 62. As an example, the static pressure at the outlet 62 in a typical internal combustion engine will be the equivalent of a minimum of 15 to 20 inches of fuel lower in pressure than the total pressure (which is the same as the pressure at the surface of the fuel 150).

As shown diagrammatically, the fuel reservoir 148 includes an aperture 156 open to the ambient surroundings. Therefore, the fuel 150 within the reservoir 148 is maintained at ambient pressure.

The metering system of the float regulator 140 operates in a known manner. Since the aperture 156 is opened to ambient pressure, and assuming fuel pressure in the inlet 92 is greater than ambient pressure, fuel enters the reservoir 148 from the inlet 92 and maintains a level permitted by the float 146. The fuel 150, at ambient pressure, also enters the conduit 152, and is present at the distribution outlet 62 if the air pressure at the outlet 62 is less than the pressure of the fuel 150. With the distribution outlet aimed upstream in the orientation illustrated in FIG. 17, the total presssure is experienced. Since the total pressure equals the ambient pressure, at the orientation illustrated fuel flow through the outlet 62 will be prevented. However, if the fuel inlet tube 40′ is rotated slightly, the pressure experienced at the distribution outlet will be less than the total pressure. Thus, fuel will flow from the distribution outlet 62. The fuel-/air mixture is therefore controlled by the rotational orientation of the fuel inlet tube 40′, in the same manner as described above with regard to prior embodiments.

It should be understood that the above assumption of equality of total pressure and ambient pressure is incorrect if an air filter or other pressure loss device is installed in the air inlet upstream of the carburetor. In such a case, a conduit providing communication between the aperture 156 and the total pressure existing at the outlet 18 must be installed to assure that the pressure in the regulator 140 equals the total pressure.

ACHIEVEMENTS

The invention provides novel, precise system for metering fluid flow and mixing of two fluids. By appropriate orientation of the fuel outlet 62 of the fuel inlet tube 40 in combination with regulated fuel pressure and appropriate adjustment of the throttle valve 14, an optimum fuel/air ratio can be provided over the full range of an engine power and operating environment.

Because no obstructions exist downstream of the fuel outlet, the carburetor according to the invention is non-icing. This feature is quite advantageous particularly in aircraft which operate at altitudes or temperatures where icing can occur in conventional carburetors.

Conventional carburetors which are used in automotive applications require a choke valve of some nature to provide extra richness for engine starting. No choke valve is required in the present invention since the required richness for starting can be obtained by the combination of the fuel inlet tube 40, throttle valve 14, and pressure and outlet rate of the fuel within the inlet tube 40.

Acceleration enrichment is not normally required with the invention. In a conventional carburetor, fuel is kept in a float reservoir at some distance from the fuel outlet, and thus some finite period of time is required when additional fuel flow is needed. In the present invention, additional fuel flow capability is always present at the outlet 62.

With the exception of the embodiment of FIG. 17, the invention can be used at any attitude orientation, and also with the exception of the embodiment of FIG. 17 can be used in any condition of horizontal or vertical acceleration. Conventional carburetors having a float system for fuel metering require a substantially consistent orientation to prevent fuel starvation or flooding in the carburetor.

Although the invention has been disclosed in the environment of a carburetor, it should be evident that the novel fluid mixing and metering characteristics of the invention may be employed in other applications requiring precise control of the mixing of the two fluids, either one of which may be liquid or gas. Various changes may be made to the invention without departing from the spirit thereof or scope of the following claims.

What is claimed is:

1. In a fluid device having a first fluid passageway, a throttle valve having an adjustable throttle opening mounted to alterably constrict the first fluid passageway and thereby control the effective cross-sectional dimension of the passageway, and a fluid metering system for supplying a second fluid to the first fluid passageway for mixture with the first fluid passing therethrough, the improvement wherein the fluid metering system comprises:

a. a fluid supply including means for supplying a substantially continuous distribution of said second fluid across said throttle opening, said supply means having a distribution outlet extending across said throttle opening, and said second fluid being supplied along the entire distribution outlet, b. means responsive to adjustment of said throttle opening to change the effective length of said distribution outlet responsive to change of the effective cross-sectional dimension of the first fluid passageway, c. fluid opening means in said distribution outlet to supply a non-uniform distribution of said second fluid across said throttle opening, said fluid opening means increasing in fluid discharge rate at a greater rate than the increase of the effective cross-sectional dimension of said first fluid passageway as the throttle valve is opened in order to increase the distribution of said second fluid as the effective cross-sectional dimension of said first fluid passageway is increased, d. means to maintain the second fluid at a pressure no greater than the total pressure of the first fluid, and e. means to alter the proportionate flow of the second fluid through said distribution outlet in relation to the flow of the first fluid in said passageway, said means to alter including means for sensing the dynamic pressure of said first fluid and for altering the rate of supply of said second fluid responsive to a percentage of said sensed dynamic pressure.

2. A mixing device according to claim 1 in which said fluid supply includes a tube extending across said throttle opening.

3. A mixing device according to claim 2 in which said distribution outlet is located in said metering tube across said throttle opening.

4. A mixing device according to claim 3 in which said distribution outlet comprises a plurality of apertures spaced axially along one side of said metering tube.

5. A mixing device according to claim 3 in which said distribution outlet comprises a plurality of apertures located at different circumferential locations such that as the throttle is opened, the last apertures to be exposed are circumferentially positioned at different angles than earlier exposed apertures to sense a smaller percentage of the dynamic pressure of said first fluid and thereby cause the last exposed distribution apertures to dispense a greater volume of said second fluid than the first exposed distribution apertures.

6. A mixing device according to claim 3 in which said distribution outlet comprises at least one axial slot along one side of said metering tube.

7. A mixing device according to claim 3 in which said distribution outlet comprises at least one slot configured such that different portions of the slot are located at different circumferential locations on the metering tube.

8. A mixing device according to claim 2 in which said metering tube is positioned in registration with said throttle valve and extends through a complementary longitudinal aperture in said throttle valve, and said throttle valve is slidable upon said metering tube to simultaneously adjust the throttle opening and thus change the effective length of said distribution outlet.

9. A mixing device according to claim 2 including means to adjust the axial location of said metering tube.

10. A mixing device according to claim 2 in which said metering tube is fixed to and axially movable with said throttle valve and is positioned in axial registration with a normally stationary conduit such that the effective length of said distribution outlet is changed by said conduit responsive to movement of said throttle valve to adjust the throttle opening.

11. A mixing device according to claim 10 in which said metering tube is located within said conduit.

12. A mixing device according to claim 11 including means to adjust the axial location of said conduit.

13. A mixing device according to claim 1 in which said supply means comprises a metering tube having said distribution outlet extending along one side thereof, and said means to alter comprises means to rotate said metering tube about its longitudinal axis to change the circumferential location of said distribution outlet with respect to said first fluid passageway.

14. A mixing device according to claim 1 in which said supply means comprises a fixed metering tube having said distribution outlet extending along one side thereof, and said means to alter comprises a pressure detecting tube in communication with said first fluid, said detecting tube including means to sense a pressure of said first fluid, and said means to alter further including means to control the pressure of said second fluid at substantially the magnitude of said sensed pressure of said first fluid.

15. A mixing device according to claim 14 in which said means to sense comprises an inlet in one side of said detecting tube, said detecting tube being rotatable to change the circumferential location of said inlet and thereby change the sensed pressure of said first fluid.

16. A mixing device according to claim 14 in which said means to control comprises a balancing regulator regulated by said sensed pressure, said balancing regulator having an inlet for said second fluid, and including a fluid control responsive to said sensed pressure and operable to permit flow of said second fluid through said second fluid inlet at such a rate so as to cause substantial equality of pressure between the second fluid and the sensed pressure.

17. A mixing device according to claim 1 in which said means to alter comprises a first pressure transmitting tube having one end extending into said first fluid oriented so as to detect the total pressure thereof and a second pressure transmitting tube having one end extending into said first fluid at said first fluid passageway oriented so as to detect the static pressure thereof, said tubes being joined at their other ends and having a third pressure transmitting tube leading therefrom, said second pressure transmitting tube having valve means therein operable to permit a portion of the total pressure in said first pressure transmitting tube to bleed into said second pressure transmitting tube leaving a resultant differential pressure in said third pressure transmitting tube, and said means to alter further including means to control the pressure of said second fluid at the magnitude of said differential pressure.

18. A mixing device according to claim 17 in which said means to control comprises a balancing regulator regulated by said differential pressure, said balancing regulator having an inlet for said second fluid, and including a fluid control responsive to said differential pressure and operable to permit flow of said second fluid through said second fluid inlet at such a rate so as to maintain equality of pressure between said second fluid and said differential pressure.

19. A mixing device according to claim 1 including a source of said second fluid maintained at a pressure at least as great as the total pressure of said first fluid, and further including means to control the pressure of said second fluid in said fluid supply at a pressure no greater than the total pressure of said first fluid.

20. A mixing device according to claim 19 in which said means to control comprises a balancing regulator having an inlet for said second fluid from said source, and including a fluid control operable to permit flow of said second fluid through said second fluid inlet at such a rate so as to maintain the pressure of said second fluid no greater than the total pressure of said first fluid.

21. A mixing device according to claim 19 in which said means to control comprises a fluid chamber having an inlet for said second fluid from said source, and including a valve in said inlet for controlling flow of said second fluid from said source into said fluid chamber, and further including a float positioned in the second fluid in said chamber and connected to said valve to manipulate said valve responsive to the level of said second fluid in said chamber.

22. In a carburetor having an air passageway, a movable throttle valve having a throttle opening movable across the air passageway to control the effective cross-sectional dimension of the air passageway, and a fuel source for supplying fuel to the air passageway for mixture with air passing therethrough, the improvement comprising a fuel metering system having a. a normally axially stationary fuel metering tube connected to said fuel source and extending across said air passageway, said metering tube being positioned in registration with said throttle valve and extending through a complementary lateral aperture in said throttle valve such that said throttle valve is slidable upon said metering tube with said metering tube extending across the throttle opening, b. a longitudinal fuel distribution outlet in said metering tube extending substantially across the width of said air passageway, c. means to maintain the fuel at a pressure no greater than the total pressure of the air in the air passageway, and d. means to rotate said metering tube about its longitudinal axis to change the circumferential location of said fuel distribution outlet and thereby alter the flow of fuel through said fuel distribution outlet, said tube being rotatable between an orientation at which only said total pressure is applied at said outlet and an orientation at which only the static pressure of the air in the air passageway is applied at said outlet.

23. In a carburetor having an air passageway, a movable throttle valve having a throttle opening movable across the air passageway to control the effective cross-sectional dimension of the air passageway, and a fuel source for supplying fuel to the air passageway for mixture with air passing therethrough, the improvement comprising a fuel metering system having a. a fuel metering tube fixed to the movable throttle valve and extending across said air passageway, said metering tube being positioned in axial registration with a normally stationary conduit connected to said fuel source, b. a longitudinal fuel distribution outlet in said metering tube extending substantially across the width of said air passageway, said outlet being located such that the effective length of said outlet is changed by said conduit responsive to movement of said throttle valve to adjust the effective cross-sectional dimension of the air passageway, c. means to maintain the fuel at a pressure no greater than the total pressure of the air in the air passageway, and d. means to rotate said metering tube about its longitudinal axis to change the circumferential location of said fuel distribution outlet and thereby alter the flow of fuel through said fuel distribution outlet, said tube being rotatable between an orientation at which only said total pressure is applied at said outlet and an orientation at which only the static pressure of the air in the passageway is applied at said outlet.

24. In a fluid mixing device having a passageway for a first fluid and an adjustable throttle opening for alternately constricting flow of said first fluid through said passageway, and further including a fluid metering system for supplying a second fluid to said passageway for mixture with the first fluid passing therethrough, the improvement comprising:

means for regulating the rate of supply of said second fluid into said passageway, said regulating means including means for sensing the dynamic pressure of said first fluid in said passageway and for altering the rate of supply of said second fluid responsive to a percentage of said sensed dynamic pressure, a fluid supply including a longitudinal distribution outlet for supplying a substantially continuous distribution of said second fluid across said throttle opening, means responsive to adjustment of said throttle opening to change the effective length of said distribution outlet, fluid opening means in said distribution outlet to supply a nonuniform distribution of said second fluid across said throttle opening said fluid opening means increasing in fuel discharge area at a greater rate than the increase of the effective cross-sectional dimension of said first fluid passageway to increase the distribution of said second fluid as the effective cross-sectional dimension of said first fluid passageway is increased, means for maintaining the pressure of said second fluid at said distribution outlet no greater than the total pressure of said first fluid in said passageway, and in which said means for sensing and altering comprises means for changing the orientation of said distribution outlet with respect to the direction of flow of said first fluid to thereby vary the percentage of the dynamic pressure of said first fluid exerted at said distribution outlet.

25. In a gas-liquid mixing device having a gas passageway, a transversely movable throttle valve controlling an adjustable throttle opening and mounted to alternately constrict the gas passageway and thereby control its effective cross section, a liquid metering means for supplying a liquid for mixture with the gas flowing through said passageway and comprising a rotatable conduit extending across said throttle opening and including distribution outlet means for supplying a substantially continuous distribution of liquid across said throttle opening, means responsive to adjustment of said throttle opening to change the effective length of said distribution outlet responsive to movement of said throttle valve, fluid dispensing means in said distribution outlet to supply a non-uniform distribution of said fluid across said throttle opening, said fluid dispensing means increasing in effective dimension to increase the distribution of said fluid as the effective cross-sectional of said gas passageway is increased, means to maintain the liquid at a pressure not greater than the total pressure of the gas, means to alter the proportional flow of the liquid through said distribution outlet in relation to the flow of the gas in said passageway, including means for sensing the dynamic pressure of said gas flowing in said passageway and for altering the rate of supply of said liquid responsive to a percentage of said sensed dynamic pressure, and including means connected to said liquid conduit to enable its rotation without physical connection to said throttle valve.

* * * * *